US011745221B2

(12) United States Patent
Winter et al.

(10) Patent No.: US 11,745,221 B2
(45) Date of Patent: Sep. 5, 2023

(54) OPERATING METHOD FOR A SEPARATOR AND SEPARATOR

(71) Applicant: NETZSCH Trockenmahltechnik GmbH, Hanau (DE)

(72) Inventors: Frank Winter, Mühlheim (DE); Joachim Domes, Wöllstadt (DE)

(73) Assignee: NETZSCH Trockenmahltechnik GmbH, Hanau (DE)

( * ) Notice: Subject to any disclaimer, the term of this patent is extended or adjusted under 35 U.S.C. 154(b) by 55 days.

(21) Appl. No.: 17/451,985

(22) Filed: Oct. 22, 2021

(65) Prior Publication Data

US 2022/0134383 A1 May 5, 2022

(30) Foreign Application Priority Data

Nov. 3, 2020 (DE) ..... 10 2020 006 724.7

(51) Int. Cl.
*B02C 19/06* (2006.01)
*F22G 7/00* (2006.01)
(Continued)

(52) U.S. Cl.
CPC ..... *B07B 11/02* (2013.01); *B02C 19/06* (2013.01); *B02C 23/08* (2013.01); *F22G 5/123* (2013.01); *F22G 7/00* (2013.01)

(58) Field of Classification Search
CPC . F22G 5/123; F22G 5/00; B07B 11/02; B07B 11/04; B07B 7/083; B02C 19/06; B02C 19/061; B02C 19/063; B02C 19/065; B02C 19/066; B02C 19/068; B02C 23/08; B02C 23/10; B02C 23/12; B02C 23/14;
(Continued)

(56) References Cited

U.S. PATENT DOCUMENTS 7,866,582 B2 * 1/2011 Nied ..... B07B 11/04 241/39
8,047,458 B2 * 11/2011 Nied ..... B02C 23/10 241/23
(Continued)

FOREIGN PATENT DOCUMENTS

CN 107115945 A * 9/2017 ..... B02C 19/06
CN 109453876 A * 3/2019 ..... B01D 46/02
(Continued)

*Primary Examiner* — Gene O Crawford
*Assistant Examiner* — Muhammad Awais
(74) *Attorney, Agent, or Firm* — WHITMYER IP GROUP LLC

(57) ABSTRACT

An operating method for a separator for classifying, wherein superheated steam is supplied to the separator as separating gas, and wherein the temperature of the superheated steam as separating gas is selected to be so low that in particular no condensation of the superheated steam occurs in the separator. Further, a separator for classifying, wherein the separator includes a separating gas supply including a water infeed for generating superheated steam as separating gas, and wherein adjusting or regulating means for the temperature of the superheated steam are provided as separating gas and are designed in such a way that the temperature of the superheated steam as separating gas is adjusted to be so low that in particular no condensation of the superheated steam occurs in the separator.

16 Claims, 7 Drawing Sheets

(51) Int. Cl.
*B07B 11/02* (2006.01)
*B02C 23/08* (2006.01)
*F22G 5/12* (2006.01)

(58) Field of Classification Search
CPC ..... B02C 23/16; B02C 23/18; B02C 23/20; B02C 23/24; B02C 23/30
USPC ..... 209/3
See application file for complete search history.

(56) References Cited

U.S. PATENT DOCUMENTS 8,074,907 B2 * 12/2011 Nied ..... B07B 7/083 241/23
2010/0065668 A1 * 3/2010 Nied ..... B02C 19/065 241/5
2010/0170966 A1 * 7/2010 Makino ..... B02C 23/12 241/39
2010/0200681 A1 * 8/2010 Lee ..... B02C 19/06 241/5
2014/0021275 A1 * 1/2014 Nied ..... B02C 19/068 241/39
2017/0234528 A1 * 8/2017 Winter ..... F22D 1/12 122/421

FOREIGN PATENT DOCUMENTS

CN 111397395 A * 7/2020
DE 3915552 A1 * 11/1990
DE 19824062 * 12/1999
DE 102006048864 A1 4/2008
EP 2696981 B1 5/2015
JP 2012245516 A * 12/2012 ..... B02C 19/068
WO WO-2016029892 A1 * 3/2016 ..... B02C 19/186
WO WO-2020146337 A1 * 7/2020 ..... B02C 19/06

* cited by examiner

Water injection kg/h 13.42

| | | | |
|---|---|---|---|
| pressure downstream from blower | mbar(g) | | 0 |
| gas temperature downstream from classifier | °C | | 120 |
| mass flow product | kg/h | | 75 |
| thermal capacity product | J/kgK | | 1000 |
| product inlet temperature | °C | | 20 |
| product outlet temperature | °C | | 60 |
| shaft power blower | kW | | 10.9 |
| shaft power classifier | kW | | 1 |

Calculation of the mass flow of the steam

| | | |
|---|---|---|
| mass flow classifier | 250 | kg/h |
| gap | 75 | kg/h |
| addition | 0 | kg/h |
| bearing | 10 | kg/h |
| **total** | **335** | **kg/h** |

Pressure drop across the plant components

| | | |
|---|---|---|
| classifier | 300 | mbar |
| product filter | 15 | mbar |
| safety filter | 10 | mbar |
| **total pressure drop across the plant components** | **325** | **mbar** |

Pressure drop in lines

| | | |
|---|---|---|
| S_class and filter | 1 | mbar |
| line between filter and safety filter | 1 | mbar |
| line between safety filter and blower | 1 | mbar |
| line between blower and S_class | 2 | mbar |
| **total pressure drop in lines** | **5** | **mbar** |

Fig. 2

| | A | B | C | D | E | F | G | H | I |
|---|---|---|---|---|---|---|---|---|---|
| | upstream of classifier | downstream from classifier | upstream of product filter | downstream from product filter | upstream of safety filter | downstream from safety filter | upstream of blower | downstream from blower | downstream from water supply |
| pressure [mbar(g)] | -2 | -202 | -203 | -318 | -319 | 329 | 330 | 0 | 0 |
| total steam volume [m3/h] | 607 | 870 | 872 | 891 | 892 | 905 | 907 | 697 | 608 |
| temperature [°C] | 119 | 120 | 120 | 120 | 120 | 120 | 120 | 178 | 119 |
| saturated steam temperature [°C] | 99.9 | 91.4 | 91.4 | 90.9 | 90.8 | 90.5 | 90.5 | 100.0 | 100.0 |
| water supply [kg/h] | 0 | 0 | 0 | 0 | 0 | 0 | 0 | 0 | 13.42 |

Fig. 3b

Water injection kg/h 8.29

| | | | |
|---|---|---|---|
| pressure downstream from blower | mbar(g) | | 60 |
| gas temperature downstream from classifier | °C | | 120 |
| mass flow product | kg/h | | 250 |
| thermal capacity product | J/kgK | | 1000 |
| product inlet temperature | °C | | 20 |
| product outlet temperature | °C | | 60 |
| shaft power blower | kW | | 8.0 |
| shaft power classifier | kW | | 1 |

Calculation of the mass flow of the steam

| | | |
|---|---|---|
| mass flow classifier | 150 | kg/h |
| gap | 75 | kg/h |
| addition | 0 | kg/h |
| bearing | 10 | kg/h |
| **total** | **235** | **kg/h** |

Pressure drop across the plant components

| | | |
|---|---|---|
| classifier | 300 | mbar |
| product filter | 15 | mbar |
| safety filter | 10 | mbar |
| **total pressure drop across the plant components** | **325** | **mbar** |

Pressure drop in lines

| | | |
|---|---|---|
| S_class and filter | 1 | mbar |
| line between filter and safety filter | 1 | mbar |
| line between safety filter and blower | 1 | mbar |
| line between blower and S_class | 2 | mbar |
| **total pressure drop in lines** | **5** | **mbar** |

Fig. 4

| | A | B | C | D | E | F | G | H | I |
|---|---|---|---|---|---|---|---|---|---|
| | upstream of classifier | downstream from classifier | upstream of product filter | downstream from product filter | upstream of safety filter | downstream from safety filter | upstream of blower | downstream from blower | downstream from water supply |
| pressure [mbar(g)] | 58 | -242 | -243 | -258 | -259 | -269 | -270 | 60 | 60 |
| total steam volume [m3/h)] | 417 | 562 | 563 | 574 | 575 | 683 | 584 | 470 | 417 |
| temperature [°C] | 134 | 120 | 120 | 120 | 120 | 120 | 120 | 186 | 134 |
| saturated steam temperature [°C] | 101.4 | 93.3 | 93.3 | 92.8 | 92.8 | 92.5 | 92.4 | 101.5 | 101.5 |
| water supply [kg/h] | 0 | 0 | 0 | 0 | 0 | 0 | 0 | 0 | 8.29 |

Fig. 5b

OPERATING METHOD FOR A SEPARATOR AND SEPARATOR

TECHNICAL FIELD

The present invention relates to an operating method for a separator as well as a separator for classifying.

BACKGROUND

An operating method for a wind separator as well as a corresponding wind separator, in each case integrated into a jet mill for generating finest particles, is known from DE 102006048864 A1. This wind separator of the jet mill includes a separating wheel and a separating wheel shaft as well as a separator housing. A separator gap is thereby defined between the separating wheel and the separator housing, and a shaft passage is formed is formed between the separating wheel shaft and the separator housing. In the case of this wind separator, it is provided that a gap flushing of separator gap and/or shaft passage takes place with compressed gases of low energy content, even though the grinding nozzles of the jet mill themselves are charged with energy-rich superheated steam. The special feature of this design is the combination that grinding nozzles are loaded with energy-rich superheated steam, thus a high-energy medium, while low-energy media are used in the case of the separator.

An operating method for a jet mill plant and a jet mill plant, each comprising a separator, is known from EP2696981B1, which includes a separator shaft and a bearing housing for said separator shaft as well as a separating wheel, wherein superheated steam is used as operating means for the jet mill plant, and wherein the supply of seals between the separator shaft and the bearing housings thereof as well as between the separating wheel and a fine product discharge housing of the jet mill plant takes place by means of the superheated steam.

SUMMARY

The known methods and separators generally lead to good results. It is the goal of the present invention to improve the operating method for a separator as well as a separator in such a way that the higher fineness in the case of the output ground product can be attained in particular compared to a separation by means of air or inert gases.

This goal is reached by means of an operating method for a separator for classifying in particular grinding material, wherein superheated steam is supplied to the separator as separating gas, and wherein the temperature of the superheated steam as separating gas is selected to be so low that in particular no condensation of the superheated steam occurs in the separator.

The above-mentioned goal is further is further reached by means of a separator for classifying in particular grinding material, wherein the separator includes a separating gas supply comprising a water infeed for generating superheated steam as separating gas, and wherein adjusting or regulating means for the temperature of the superheated steam are provided as separating gas and are designed in such a way that the temperature of the superheated steam as separating gas is adjusted to be so low that in particular no condensation of the superheated steam occurs in the separator.

The inventors have recognized that the separating result during a separation by means of a dynamic separating wheel is a function on the used process gas, i.e. separating gas, among other things. By means of the selection of the separating gas, the separating step between coarse material, which is supplied, for example, to the further grinding, and fine material, which, as desired output product, is thus output from the separator as final product or for further processing, can thus be influenced. For example, when using argon compared to air, the separation limit shifts by 18% towards being coarse, with otherwise unchanged process parameters:

$$dt_{argon}=1.18dt_{air},$$

wherein $dt_{argon}$=separating grain diameter argon (use as separating gas)

$dt_{air}$=separating grain diameter air (use as separating gas)

In other words, the output product is output in a coarser manner only by means of the use of argon instead of air as separating gas. The inventors thereby further found out as invention that when using superheated steam as separating gas compared to air, the separation limit shifts towards being fine:

$$dt_{steam}=0.8dt_{air},$$

wherein $dt_{steam}$=separating grain diameter steam (use as separating gas)

Practical analyses have shown that during the separation with superheated steam as separating gas, even significantly higher fineness is attained, than is suggested by the above-mentioned theoretic factor of 0.8 compared to air.

It is assumed that the improved separation limit or separation sharpness when using superheated steam instead of air as separating gas a type of additivation of the product occurs during the separating process, which further results in a significantly higher yield in an advantageous manner.

The inventors have furthermore recognized that during the separation with superheated steam, the temperature of this separating gas is relevant for the result. They have thus found that the separator separates more coarsely in the case of higher separating gas temperatures and that it is thus a further criterion that due to the fact that superheated steam condenses when falling below the saturated steam temperature, the separating gas temperature is to be set in such a way when using superheated steam that a condensation of the steam in particular does not occur in the process. The technical from this is thus that a minimum of the necessary separating gas temperature, i.e. of the hot steam or superheated steam, should be sought:

$$d_{th}=(T_h/T_u)^{0.25}$$

wherein $dt_h$=separating grain diameter as a function of the temperature of the separating gas $T_h$=high temperature of the separating gas $T_u$=lower temperature of the separating gas Limits of the temperature for superheated steam:

$T_u$=approx. 383 K (approx. 10 K above saturated steam temperature)

$T_h$=approx. 723 K

Further parameters, which are noteworthy in the context of the invention and which are to advantageously be included in particular in the selection and adjustment of the temperature of the separating gas, both procedurally and with regard to equipment by means of corresponding sensor and determining means, and in each case individually or in any combination, are:

the absolute pressure at the separator inlet in bar(a)

the thermal capacity of the separating material in J/kgK the temperature of the separating material in K
the feed quantity of the product in kg/h
the energy input of the separating gas/process gas compressor
the energy input by means of the separator
the mass of the injected water for generating steam and cooling the process gas in kg/h
heat flow losses due to emission to the environment in W In the case of the operating method for a separator for classifying in particular grinding material, it can advantageously further be provided that the superheated steam is used in a recirculating gas process. It can thereby be provided as preferred and advantageous further development that the necessary superheated steam is generated by the supply of liquid water.

A further preferable design of the operating method for a separator for classifying in particular grinding material lies in that superheated steam is supplied to the separator also for flushing a separator gap of the separator and/or for protecting the bearings of the separator against product contaminations.

Advantageously, the operating method for a separator for classifying in particular grinding material can be further developed in that a pressure difference is generated by means of a separating gas blower or separating gas compressor in order to convey the flow of the separating gas, optionally in the cycle. It can thereby further preferably be provided that the pressure difference is adjusted or regulated as a function of plant resistances, wherein it can even further in particular be provided that the temperature of the superheated steam is used as separating gas in the separator in connection with the heating and the output of the separating material for the adjustment or regulation of the temperature of the superheated steam.

An even further preferred design for the operating method for a separator for classifying in particular grinding material lies in that the temperature of the superheated steam as separating gas takes place by means of adjustment or regulation of quantity and/or temperature of liquid water, which is introduced into the separating gas.

The separator can advantageously be further developed in that a cycle for the superheated steam is present. In the alternative or in addition, it can be provided that flushing means are present for a separator gap of the separator and/or to protect the bearings of the separator against product contaminations, and are designed to supply superheated steam to the corresponding spots.

Yet a further advantageous design of the separator lies in that a separating gas blower or separating gas compressor for conveying the flow of the separating gas is optionally present in the cycle by means of a pressure difference. It can hereby advantageously further be provided that adjusting or regulating means are provided for the separating gas blower or the separating gas compressor for adjusting or regulating the pressure difference as a function of plant resistances, which can be further developed even more by means of at least one temperature probe for the superheated steam, which is assigned to the outlet of the separator, and which is functionally coupled to the adjusting or regulating means for the temperature of the superheated steam as separating gas, so that the output of this temperature probe is used as input, which is to be considered, of the adjusting or regulating means for the temperature of the superheated steam.

It can moreover advantageously be provided in the case of the separator that the water infeed are coupled to the adjusting or regulating means for the temperature of the superheated steam as separating gas and are designed in such a way that the adjustment or regulation of the temperature of the superheated steam as separating gas is realized via this by means of adjustment or regulation of quantity and/or temperature of liquid water, which is introduced into the separating gas.

Further preferred and/or advantageous designs of the invention and of its individual aspects result from combinations of the dependent claims as well as from the entire application documents at hand.

BRIEF DESCRIPTION OF THE DRAWINGS

A few exemplary descriptions for concrete designs are also specified below, and exemplary embodiments of the invention are described only in an exemplary manner with reference to the drawing, in which FIG. 2 shows operating parameters of a first sample calculation, FIGS. 3*a* and 3*b* show process parameters of a first sample calculation, FIG. 4 shows operating parameters of a second sample calculation, and FIGS. 5*a* and 5*b* show process parameters of a second sample calculation.

DETAILED DESCRIPTION

The invention will be described in more detail only in an exemplary manner by means of the described exemplary embodiments and examples of use, i.e. it is not limited to these exemplary embodiments and examples of use. Method and device features in each case follow analogously also from device or method descriptions, respectively.

Individual features, which are specified and/or illustrated in connection with a concrete exemplary embodiment, are not limited to this exemplary embodiment or the combination with the remaining features of this exemplary embodiment, but can be combined with any other alternatives, even if they are not separately discussed in the present documents, as far as technically possible.

Figure 1:
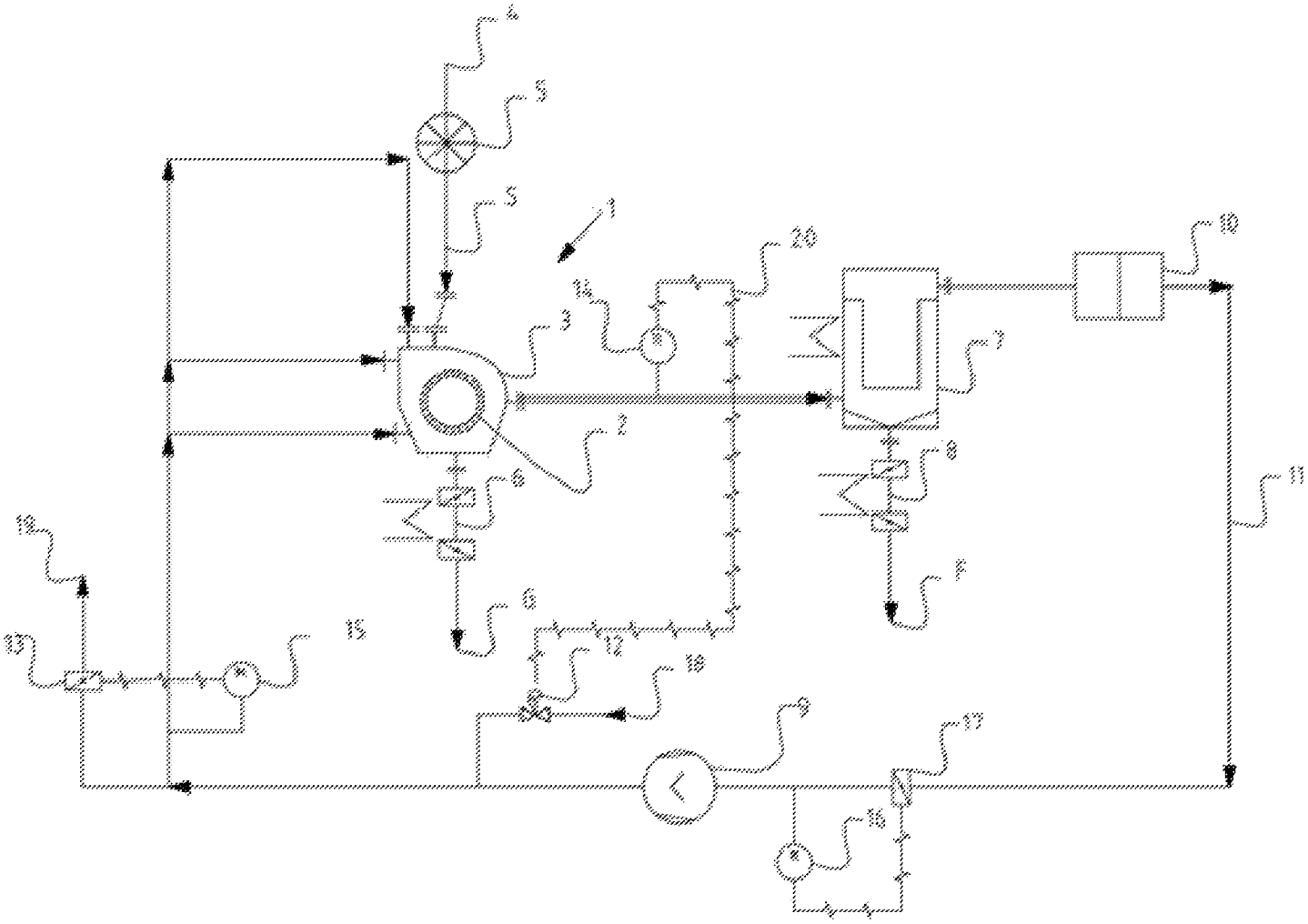
FIG. 1 shows a schematic diagram of a process according to the invention comprising a separator.

An exemplary embodiment of a separator 1 is illustrated in FIG. 1 in a schematic diagram, in which the individual components of the separator 1 and the connections thereof are illustrated only in an exemplary manner. The size ratios of the components of the separator 1 illustrated in FIG. 1 do not correspond to reality, but were selected in the given manner only for a better understanding and for reasons of recognizability.

The underlying method is a method for separating, i.e. for classifying, in particular grinding material, in particular but not mandatorily from a mill (not shown), such as, for example, a jet mill, with superheated steam, preferably but not limited thereto in a recirculating gas process, wherein the separator 1 is integrated in the mill during the process run, optionally upstream of a grinding material outlet, or can be connected downstream from the mill, i.e. the grinding material outlet thereof, as separate apparatus.

The separator 1 includes a dynamic separator wheel 2, which is arranged in a separator housing 3 so as to be capable of rotating around a separator wheel axis (not shown), and which is spaced apart by means of a so-called separator gap (not shown) from the inner wall (not identified) of the separator housing 3. The separator wheel 2 is rotatably supported in at least one bearing (not shown) of the separator 1 in order to accomplish the rotatability thereof.

An exemplary embodiment, which is to only be understood in an exemplary manner in order to clarify setup and operating method of the separator 1 will be described below with further details with reference to FIG. 1. This description includes the generation of superheated steam and of the recirculation gas process, all of which is to be understood as only one possibility in each case. Superheated steam can also be provided and supplied in a different way, and can also be used outside of a recirculating gas process. This means in particular that the separating process with superheated steam can generally be described in the recirculating gas operation as well as in the through-gas operation. In a particularly advantageous manner, the energy demand of the recirculating gas process, however, is thereby preferably only approx. 5% of the operation in the through-gas. This has to do with the fact that in open operation, the steam leaves the plant in a superheated manner and is irrevocably lost.

The product flow in the separator 1 is as follows:

Separating material S, which originates, e.g., from a mill (not shown) or the grinding chamber thereof (not shown), is supplied to the separator 1 via a separating material feed as separator inlet 4. In order to separate the process from the atmosphere, the separating material S is introduced in a metered manner into the separator housing 3, for example, but not mandatorily, via a rotary gate valve as feed gate 5. Coarse material G, which has to be ground further or once again or which is sorted out, because it is still too coarse, leaves the separator 1, for example through a coarse material gate 6.

Fine material F, which meets the desired final specifications, passes through the separator wheel 2 and is conveyed into a filter 7 with separating gas, and leaves this filter 7 for closing off with respect to the atmosphere, for example through a fine material gate 8. The separating gas is at least largely transferred to a separating gas or generally process gas compressor 9, upstream of which for example a safety or police filter 10 is connected for the protection thereof.

A description now follows of the flow of the separating flow, or based on the separator, generally process gas flow, for the exemplary embodiment, which is illustrated schematically in FIG. 1.

In the case of the shown example, the separating gas compressor, which can be realized, e.g., by means of a separating gas blower 9 and which can be referred to as such, generates the necessary pressure difference for conveying the process gas and in particular separating gas in a cycle. The separating/process gas blower or the separating/process gas compressor 9 is to thereby advantageously be designed in such a way that all plant resistances can be overcome in order to generate a stable process gas flow and in particular separating gas flow.

The process gas in the form of superheated steam divides into 3 partial flows:

1) separating gas
2) cracked gas for flushing the separator gap
3) bearing gas to protect the bearings against product contaminations Superheated steam is used for all 3 partial gas flows, the sum of which result in the process gas flow, but of which only the separating gas flow is relevant for the aspects according to the invention for generating a higher/better fineness of the fine material F. It is advantageous and is to thus preferably be sought not to supply any air into the recirculating gas process, if possible. This would lead to a dilution of the process gas and to a shift of the viscosities and densities, which would shift the separation of the separator to be coarse.

It is advantageous, among other things, when the bearing (not shown) and also the separator gap (not shown) of the separator 1 is likewise flushed with superheated steam, which is branched off from the separating gas stream for these purposes.

Further components of the exemplary embodiment of the separator 1 shown in FIG. 1 are a pipeline 11, water injection fittings 12, a regulating valve 13, a temperature sensor 14, an operating pressure sensor 15, a supply pressure sensor 16, a regulating valve 17, a water infeed 18, and an exhaust steam outlet 19.

Due to the fact that superheated steam condenses when falling below the saturated steam temperature, the separating gas temperature is to be set in such a way when using superheated steam that a condensation of the steam in particular does not occur in the process. In other words, a minimum of the necessary separating gas temperature is to be sought here.

$$dt_h=(T_h/T_u)^{0.25}$$

wherein $dt_h$=separating grain diameter as a function of the temperature of the separating gas $T_h$=high temperature of the separating gas $T_u$=lower temperature of the separating gas Limits of the temperature for superheated steam:

$T_u$=approx. 383 K (approx. 10 K above saturated steam temperature)

$T_h$=approx. 723 K

Further parameters, which are noteworthy in the context of the invention and which are to advantageously be included in particular in the selection and adjustment of the temperature of the separating gas, both procedurally and with regard to equipment, by means of corresponding sensor and determining means, and in each case individually or in any combination, are:

the absolute pressure at the separator inlet in bar(a)
temperature of the separating material in K
the thermal capacity of the separating material S in J/kgK
the feed quantity of the product in kg/h
the energy input of the separating gas/process gas compressor
the energy input by means of the separator
the mass of the injected water for generating steam and cooling the process gas in kg/h
heat flow losses due to emission to the environment in W, can be neglected in the case of sufficient isolation and heat tracing (see FIG. 1, reference numerals 6, 7, 8).

The generation of the superheated steam will be discussed below in an exemplary manner and in detail in this respect.

In the recirculating gas process, energy flows are supplied and discharged. An energy balance can be performed during the permissible assumption of an adiabatic system in the recirculating gas process.

Supplied energy flows: Q.sup
product (separating material S) Q.=ṁ*cp*T
separator (drive) Q.=Pw (shaft power)
process gas blower Q.=Pw (shaft power)
water liquid Q.=h*ṁ
Discharged energy flows: Q.dis
fine material F Q.=ṁ*cp*T
course material G Q.=ṁ*cp*T
exhaust steam O.=m*h
Difference of the energy flows:

$dQ.=m\text{H2O}*(h \text{ exhaust steam}-h \text{ H2O liquid})$ wherein

Q.=heat energy in Watt

ṁ=mass flow kg/s cp=thermal capacity in j/kgK

T=temperature in K h=enthalpy in J/kg

The difference of the energy flows is used to evaporate and to overheat the added liquid water.

In the case of the shown exemplary embodiment, it is crucial thereby that the addition quantity of the liquid water, which is supplied via the water infeed 18, takes place in such a way that the resulting steam is present in superheated form at each spot of the plant due to the difference of the energy flows. The water infeed 18 is connected downstream from the separating or process gas blower in the flow direction of the separating and process gas, where the highest temperature level lies in the plant, i.e. of the separator 1 with all of its components.

The temperature regulation in the recirculating gas process will now be discussed in more detail in the case of the presently addressed exemplary embodiment.

To ensure that the steam is present in superheated form at each spot of the plant, i.e. of the separator 1, the recirculating gas temperature is measured at different spots of the plant.

The temperature downstream from the separator 1 is used as regulating variable. As expected, the largest temperature drop will be generated here due to the heating and the output of the separating material. This temperature drop can be calculated. A defined water quantity in liquid state is supplied downstream from the separating gas or process gas compressor as a function of the temperature downstream from the separator 1. The water quantity to be supplied is selected in such a way that a sufficient temperature difference above saturated steam temperature (approx. dT=10 to 100 K) is applied upstream of the separating gas or process gas compressor.

The following parameters can be considered for the adjustment or regulation of the water quantity to be supplied, which is realized via corresponding sensors (not shown) as well as adjusting or regulating means 20:

- the absolute pressure of the process gas upstream of the process gas compressor in bar(a)
- the thermal capacity of the separating material S in J/kgK
- temperature of the separating material in K
- the feed quantity of the product in kg/h
- the energy input of the process gas compressor
- the energy input by means of the separator The process is cooled by means of the evaporation enthalpy of the water, and can thus be held at a constant temperature level. Superheated steam is generated thereby. A falling below of the saturated steam temperature is to be avoided by all means because condensate is otherwise generated, and a secure mode of operation of the process is thus no longer possible. Due to the fact that the saturated steam temperature is a function of the pressure, this pressure is preferably measured continuously in the plant, i.e. in the separator 1, and the saturated steam temperature is calculated therefrom. A reconciliation with the actual temperatures preferably likewise takes place continuously.

To ensure that no heat flow loss to the environment occurs, the complete plant, i.e. the separator 1, is preferably heat insulated. The input elements, in particular rotary gate valve as feed gate 5, and output elements, in particular coarse material gate 6 and fine material gate 8, as well as filter 7 and safety or police filter 10, are advantageously equipped with additional trace heating.

Some details for the pressure regulation in the recirculation gas process will now also be specified for the respective exemplary embodiment.

The supplied water quantity, which is evaporated and superheated by means of the energy differences between input and output in the recirculating gas process, has to leave the cycle again, because the pressure would otherwise rise in the plant. For this purpose, an operating pressure sensor 15, which regulates the plant pressure via the regulating valve 13 or a corresponding regulating flap, is installed upstream of the separator housing 3. As a function of the supplied water quantity and discharged gas quantity, any or required plant pressure can thus be adjusted. The air located in the plant and the air supplied by means of the product during the operation are discharged from the process due to this water quantity, which transitions into superheated steam.

A further pressure regulation via the supply pressure sensor 16 and the regulating valve 17 is provided upstream of the separating gas or separating or process gas compressor 9. If necessary, the total plant resistance can be increased thereby. As a result, the energy input is increased by means of the separating/process gas blower or the separating/process gas compressor 9. This can be necessary in the case of very high throughputs and, associated therewith, stronger cool-down of the process gas during the separating process by means of the discharge of coarse material G and fine material F.

Plant characteristic curves/process parameters/operating parameters are shown in an exemplary manner in FIGS. 2 to 5. For this purpose, different calculations have been made in order to show, to what extent the process parameters and water quantities, which are to be supplied, change as a function of the operating parameters. The corresponding calculations were made in an exemplary manner for one separator type. A scale-up to other variables can be made.

Figure 3A:
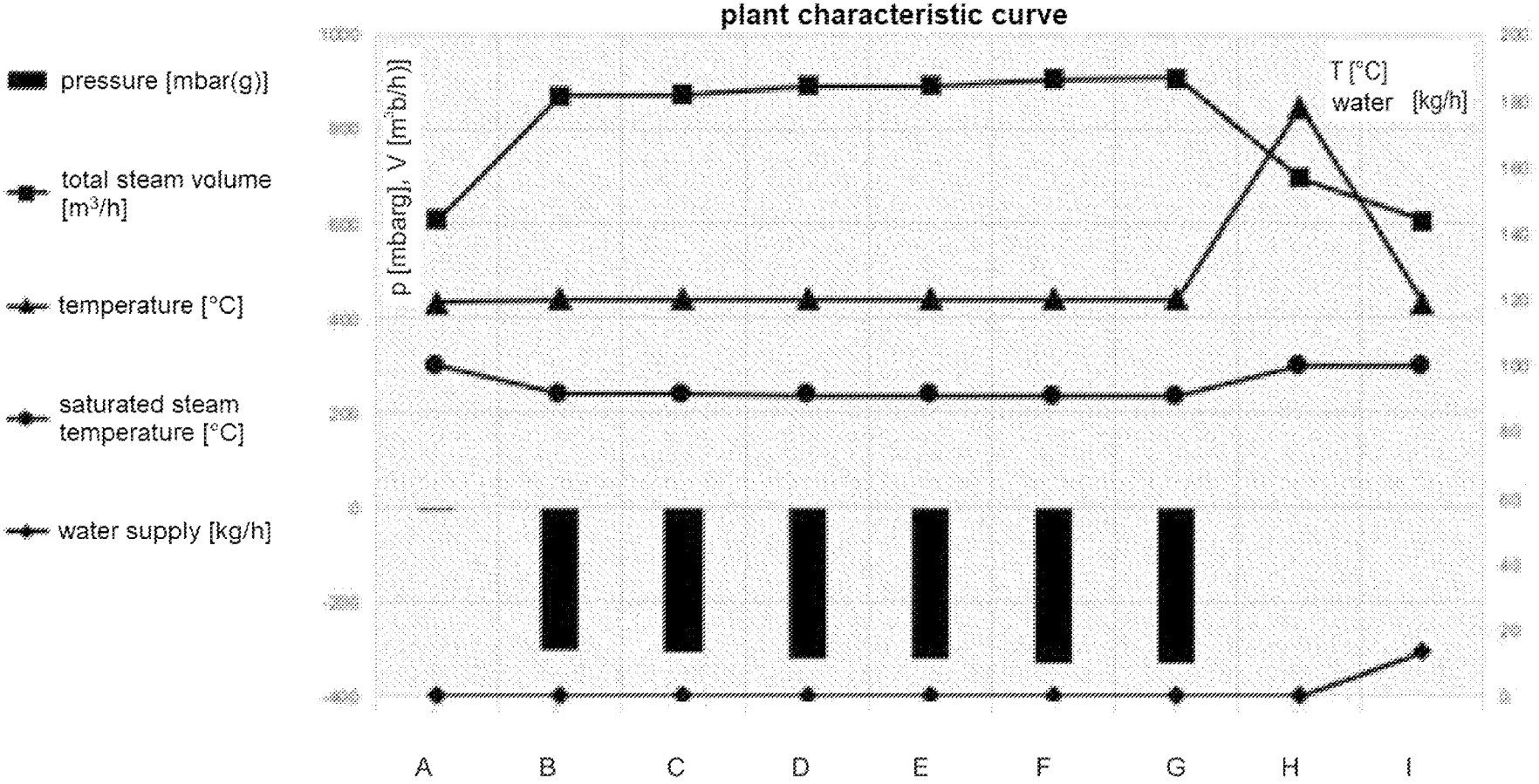
Figure 5A:
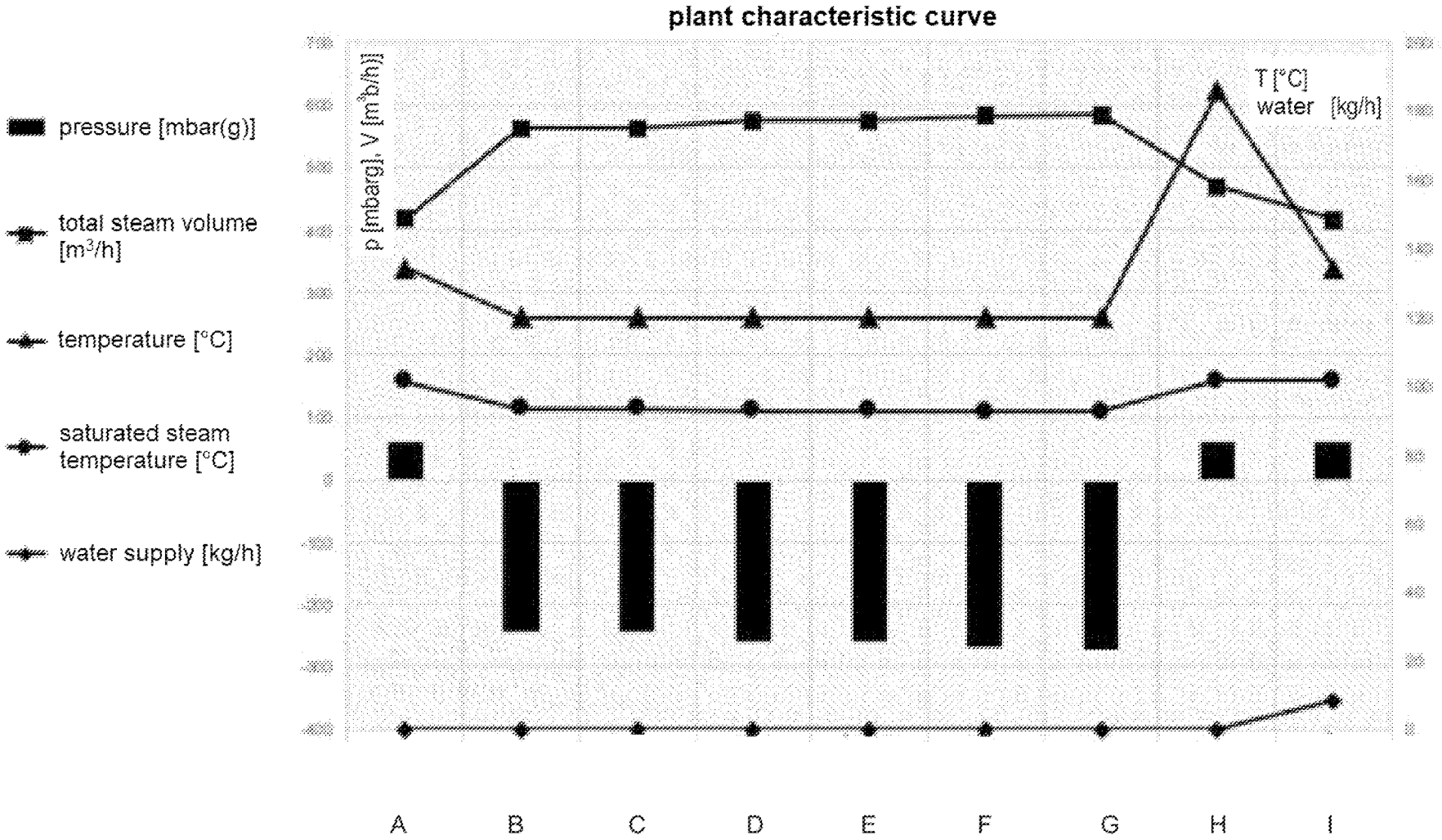

For a first sample calculation, the operating parameters are illustrated in FIG. 2 and the process parameters are illustrated in FIGS. 3*a* and 3*b* (for the sake of clarity, the values for the measuring points A to I in FIG. 3*a* are illustrated in the table in FIG. 3*b*), and the operating parameters (change of the feed capacity of the separator 1 and reduction of the circulating steam quantity and of the plant pressure downstream from the process gas compressor 9) are illustrated in FIG. 4, and the process parameters are illustrated in FIG. 5 (for the sake of clarity, the values for the measuring points A to I in FIG. 5*a* are illustrated in the table in FIG. 5*b*).

With regard to equipment, following features of the process are to be mentioned or emphasized as individual or combinable effects and design options for the operating method for the comparator 1 for classifying in particular grinding material as well as this separator 1:

- selection of the process gas—superheated steam for finer separations and higher yields
- flushing of the bearings with the process gas (superheated steam) in order to prevent a dilution of the process gas
- addition of liquid $H_2O$ for the temperature regulation of the process gas
- addition of liquid $H_2O$ for the generation of the process gas (superheated steam)
- regulation of the water addition as a function of the saturated steam temperature
- regulation of the water addition as a function of the supplied and discharged heat quantity flows adjustment of the saturated steam temperature by means of variable pressure regulation in the plant supply of the water addition downstream from the separating gas/process gas blower to attain the most effective evaporation and superheating change of the shaft power of the separating gas/process gas blower and thus variable adjustment of the energy input into the process via pressure-dependent regulation upstream of the separating gas/process gas compressor adiabatic system: balancing of heat losses due to trace heating at the filters, input and output elements, and insulation of the pipelines operation of the process in the recirculating gas system energy demand during the operation in the recirculating gas system is approx. 5% of the energy demand during the open operation operation in the open process is possible A further pressure regulation via the supply pressure sensor 16 and the regulating valve 17 can be provided upstream of the separating or process gas compressor 9. If necessary, the total plant resistance can be increased thereby. As a result, the energy input is increased by means of the separating/process gas blower or the separating/process gas compressor 9. This can provide for an advantageous compensation in the case of very high throughputs and, associated therewith, stronger cool-down of the process gas during the separating process by means of the discharge of coarse material G and fine material F.

The invention is described in the description only in an exemplary manner by means of the exemplary embodiment and preferred embodiments, and is not limited thereto, but comprises all variations, modifications, substitutions, and combinations, which the person of skill in the art can gather from the present documents, in particular in the context of the claims, and the general descriptions in the introduction of this description, as well as from the description of the exemplary embodiments, and which he can combine with his expert knowledge as well as the prior art. All individual features and design possibilities of the invention can in particular be combined.

The invention claimed is:

1. An operating method for a separator for classifying, the method comprising:

supplying superheated steam to the separator as a separating gas, wherein a temperature of the superheated steam as the separating gas is selected to be so low that no condensation of the superheated steam occurs in the separator;

wherein the superheated steam is generated by a supply of liquid water;

wherein a pressure difference is generated by a compressor to convey a flow of the separating gas; and wherein a defined water quantity in the liquid state is supplied downstream from the compressor as a function of the temperature of the superheated steam downstream from the separator.

2. The operating method according to claim 1, further comprising:

adjusting or regulating the temperature of the superheated steam as a function of:

an absolute pressure at a separator inlet in bar(a), a temperature of a separating material, a thermal capacity of the separating material in J/kgK, a feed quantity of the product in kg/h, an energy input of the compressor, an energy input by means of the separator, a mass of the injected water for generating steam and cooling the process gas in kg/h, and/or heat flow losses due to emission to the environment in W.

3. The operating method according to claim 1, wherein the superheated steam is used in a recirculating gas process.

4. The operating method according to claim 1, wherein superheated steam is supplied to the separator also for flushing a separator gap of the separator and/or for protecting the bearings of the separator against product contaminations.

5. The operating method according to claim 1, wherein the pressure difference is adjusted or regulated as a function of plant resistances.

6. The operating method according to claim 1, wherein the temperature of the superheated steam is used in connection with the heating and the output of the separating material for the adjustment or regulation of the temperature of the superheated steam.

7. The operating method according to claim 1, wherein the temperature of the superheated steam is adjusted or regulated based on quantity and/or temperature of liquid water, which is introduced into the separating gas.

8. A separator for classifying, comprising:

a separating gas supply comprising a water infeed for generating superheated steam as separating gas, and an adjusting or regulating means designed in such a way that the temperature of the superheated steam as separating gas is adjusted to be so low that in particular no condensation of the superheated steam occurs in the separator;

wherein a pressure difference is generated by a compressor to convey the flow of the separating gas; and wherein a defined water quantity in the liquid state is supplied downstream from the compressor as a function of the temperature of the superheated steam downstream from the separator.

9. The separator according to claim 8, wherein the pressure difference generated by the compressor conveys the flow of the separating gas in a cycle.

10. The separator according to claim 8, wherein flushing means are present for a separator gap of the separator and/or to protect the bearings of the separator against product contaminations, and are designed to supply the superheated steam to the corresponding spots.

11. The separator according to claim 8, wherein the compressor is used for adjusting or regulating the pressure difference as a function of plant resistances.

12. The separator according to claim 11, wherein at least one temperature probe for the superheated steam is assigned to the outlet of the separator, and is functionally coupled to a adjusting or regulating means for the temperature of the superheated steam as separating gas, so that the output of this temperature probe is used as input, which is to be considered, of the adjusting or regulating means for the temperature of the superheated steam.

13. The separator according to claim 8, wherein the water infeed are coupled to the adjusting or regulating means for the temperature of the superheated steam as separating gas and are designed in such a way that the adjustment or regulation of the temperature of the superheated steam as separating gas is realized via this by means of adjustment or regulation of quantity and/or temperature of liquid water, which is introduced into the separating gas.

14. The operating method according to claim 2, wherein the superheated steam is used in a recirculating gas process.

15. The operating method according to claim 2, wherein superheated steam is supplied to the separator also for flushing a separator gap of the separator and/or for protecting the bearings of the separator against product contaminations.

16. An operating method for a separator for classifying, the method comprising:

supplying superheated steam to a separator as a separating gas, wherein a temperature of the superheated steam as the separating gas is selected to be so low that no condensation of the superheated steam occurs in the separator;

wherein the superheated steam is generated by a supply of liquid water;

wherein a pressure difference is generated by a compressor to convey a flow of the separating gas in a cycle;

wherein a defined liquid quantity is supplied downstream from the compressor as a function of the temperature downstream from the separator;

supplying a separating material to the separator via a separating material feed in a metered manner into a separator housing;

wherein separating material that is coarse leaves the separator through a coarse material gate; and wherein separating material that is fine passes through a separator wheel and is conveyed into a filter supplied with superheated steam and leaves the filter through a fine material gate.

* * * * *